US005309799A

United States Patent [19]

Jore

[11] Patent Number: 5,309,799

[45] Date of Patent: May 10, 1994

[54] TRANSPARENT-SLEEVE SCREW HOLDING AND DRIVING TOOL

[76] Inventor: Matthew B. Jore, 45000 Hwy. 93 S., Ronan, Mont. 59864

[21] Appl. No.: 102,640

[22] Filed: Aug. 5, 1993

[51] Int. Cl.[5] ..... B25B 23/08

[52] U.S. Cl. ..... 81/451

[58] Field of Search ..... 81/451, 452, 125, 438

[56] References Cited

U.S. PATENT DOCUMENTS

| | | | |
|---|---|---|---|
| 2,550,775 | 5/1951 | Clark | 81/438 |
| 2,806,706 | 9/1957 | Fitch | 81/438 X |
| 2,838,082 | 6/1958 | Lange | 81/438 |
| 3,633,640 | 1/1972 | Moore | 81/451 |
| 4,221,249 | 9/1980 | Mazzeo et al. | 81/451 |
| 4,736,658 | 4/1988 | Jore | 81/451 |
| 5,029,498 | 7/1991 | Kinsey | 81/452 X |

*Primary Examiner*—D. S. Meislin

*Attorney, Agent, or Firm*—Richard C. Conover

[57] ABSTRACT

A screw holding and driving device for use with powered drills including a slidable transparent sleeve mounted in concentric relation with a screw drive shaft of the device. The sleeve is provided with an internal surface that is fluted with the fluted surfaces extending parallel to the longitudinal axis of the cylindrically shaped sleeve. The inner surfaces with larger radii remain clear of the shaft and thus will not be scratched as the shaft moves relative to the sleeve. Further, a split ring of oval construction is provided for holding the sleeve on the shaft. The ends of the split oval retaining ring are sized to fit in a groove on the shaft and thus do not extend outside the groove to scratch the transparent sleeve.

7 Claims, 2 Drawing Sheets

TRANSPARENT-SLEEVE SCREW HOLDING AND DRIVING TOOL

BACKGROUND OF THE INVENTION

This invention relates to an improved screw holding and driving tool which has a transparent sleeve to permit a user to see a screw and screwdriver bit as the screw is being driven with a powered drill.

In U.S. Pat. No. 4,736,658 the inventor disclosed a screw holding and driving device having a shank secured at one end to a handle and a screw driving bit mounted at a second end of the shank. A sleeve is positioned in surrounding relation to the shank and sized to slidably rotate around the shank and to slidably move in a longitudinal direction with respect to the shank. The sleeve is used to hold a screw head during the driving operation. Retaining means are provided to hold the sleeve on the shank.

The inventor has also been marketing a screw holding and driving tool having a drive shaft with a shank at one end to be received by a chuck of a powered drill and with a socket at the other end for receiving a socket bit. An opaque sleeve is positioned in surrounding relation to the driver shaft and is sized to slidably rotate around the shank and to slidably move in a longitudinal direction with respect to the shank. This tool is being marketed under the tradename FINDER/DRIVER.

A problem has arisen in that an operator can neither see the position of the screw nor easily determine the angle, speed, or depth that the screw is driven when driving a screw into a work piece. A simple substitution of transparent materials for the opaque outer sleeve has proved ineffective because the stationary sleeve gets scratched as the drive shank rotates to drive a screw. In addition, conventional split retaining rings used with screw holding and driving devices for holding the sleeve on the shank have exposed ends that scratch the inner surfaces of the sleeve as the drive shank rotates or when the sleeve is moved from the extended to the retracted position or vice versa. The combination of scratching from the rotation of the shank inside the sleeve, and the scratching from the extension and retraction of the sleeve has made it impossible to make a simple substitution of materials.

A need exists for a screw holding and driving device having a transparent sleeve which will resist scratching. Further, a need exists for a retaining device, used to hold the sleeve on the shank, constructed so as to operate without scratching the sleeve as the shank is rotated, or as the sleeve is extended or retracted.

SUMMARY OF INVENTION

The present invention relates to a screw holding and driving device for use with powered drills. More specifically the present invention includes a transparent sleeve of unique design, which permits an operator to see a screw as the screw is being driven.

The present invention includes a shaft having one end shaped to have a socket to receive a conventional socket bit. The other end of the shaft is shaped to be received by a chuck of a powered drill. The socket end of the shaft has a fixed magnet positioned at its innermost end to retain the socket bit in an operative position. A circumferential groove is formed on the shaft adjacent the socket end to hold a first retaining ring for holding the sleeve on the shaft. Another circumferential groove is also formed on the shaft adjacent the drill end to hold a second retaining ring for preventing the sleeve from sliding off the shaft.

A transparent, cylindrical sleeve is fitted over the shaft. This sleeve is provided with an internal circumferential groove adjacent the drill end of the sleeve when mounted on the shaft. This groove receives the first retaining ring mounted to the socket end of the shaft to prevent the sleeve from sliding off when the sleeve on the shaft is in a fully extended position. The second retaining ring located at the drill end of the shaft is sized to stop the sleeve from sliding off the shaft when the sleeve is moved to the fully retracted position.

The transparent sleeve permits an operator to see a screw as the screw is being driven. The transparent sleeve further has an interior surface that is fluted with the fluted surfaces extending parallel to the longitudinal axis of the cylindrically shaped sleeve. Only the inner surfaces with the smallest radii contact the shaft. The inner surfaces with larger radii remain clear of the shaft and thus will not be scratched as the shaft moves relative to the sleeve. These surfaces with a larger radii remain transparent by not being scratched so that an operator can see a screw being driven within the sleeve even after long use of the tool.

The retaining ring at the drill end of the shank is of circular construction and sized to have a diameter larger than the internal diameter of the sleeve so as to stop the sleeve from sliding off the shaft. The retaining ring at the socket end of the shank is a resilient, split ring of oval construction. This oval ring is constructed to provide frictional engagement with the inner surface of the sleeve to resiliently maintain the sleeve on the shaft at any longitudinal position on the shaft. The ends of the split oval retaining ring are sized to fit entirely within the groove of the shaft and thus do not extend outside this groove to scratch the transparent sleeve as the sleeve is rotated, extended or retracted.

BRIEF DESCRIPTION OF THE DRAWINGS

In order that the invention may be clearly understood and readily carried into effect, a preferred embodiment of the invention will now be described, by way of example only, with reference to the accompanying drawings wherein.

FIG. *7a* is an enlarged fragmentary detail of a groove and retaining ring located adjacent a drill end of the sleeve.

DESCRIPTION OF A PREFERRED EMBODIMENT

Figure 1:
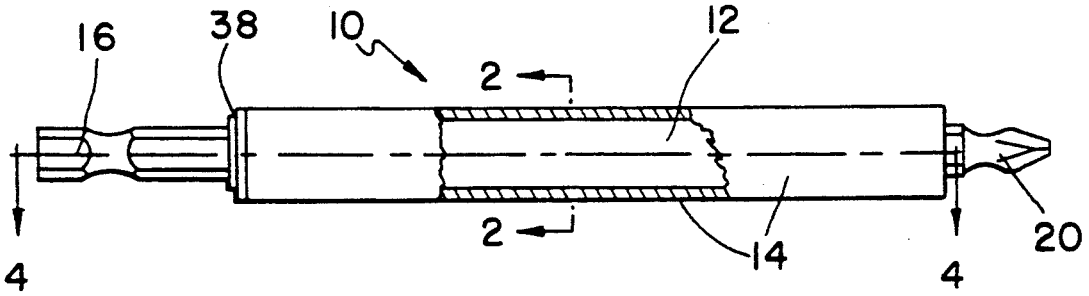
FIG. 1 is an elevational view of the screw holding and driving tool of the present invention with a portion of a transparent sleeve cut away to expose a shaft.

A preferred embodiment of an improved screw holding and driving tool 10 is shown in FIG. 1. The tool 10 includes a drive shaft 12. A transparent sleeve 14 slidably surrounds shaft 12.

Figure 4:
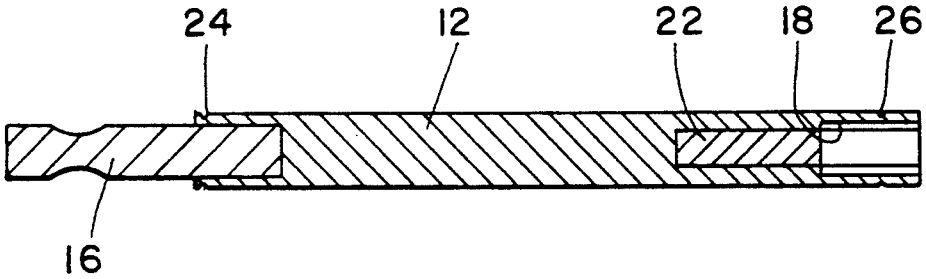
FIG. 4 is a cross-sectional view of the shaft taken along line 4—4 in FIG. 1 with the socket bit removed.
Figure 5:
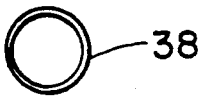
FIG. 5 is a plan view of a circular stop ring fitted adjacent a drill end of the shaft.

At one end of shaft 12, a hexagonal shaped drill shank 16 is embedded in shaft 12. This shank 16 is sized to be received by a chuck of a powered drill (not shown). At the opposite end of shaft 12, a hexagonal socket 18 is embedded in shaft 12 and is sized to accept a conventional socket bit 20. As shown in FIG. 4, a magnet 22 is embedded in shaft 12 behind socket 18 to attract and hold bit 20 whenever a socket bit is positioned within socket 18.

Figure 2:
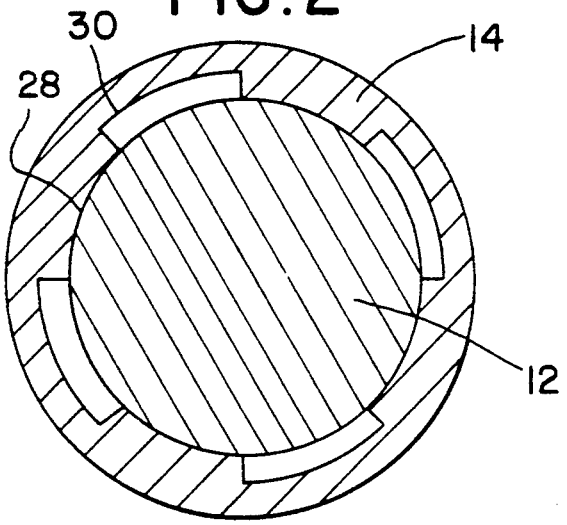
FIG. 2 is an enlarged cross-sectional view taken along the line 2—2 in FIG. 1 showing the shaft surrounded by the transparent sleeve.
Figure 3:
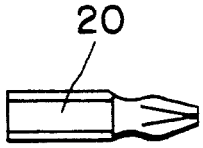
FIG. 3 is a conventional socket bit which fits into a socket of the tool shown in FIG. 1.

The transparent sleeve 14 has a fluted interior surface as best seen in FIG. 2 with the fluted surfaces extending generally parallel with the longitudinal axis of the cylindrically shaped sleeve 14. The smallest radii surfaces 28 are sized to slide over the outer surface of shaft 12 and may become scratched as the sleeve is moved relative to the shaft. Larger radii surfaces including largest radii surfaces 30 are sized to remain free of the outer surface of shaft 12 so as to remain unscratched as the sleeve moves relative to the shaft. With the fluted surfaces, an operator can see through the unscratched largest radii surfaces 30 to see the progress as a screw is being driven.

Figure 7:
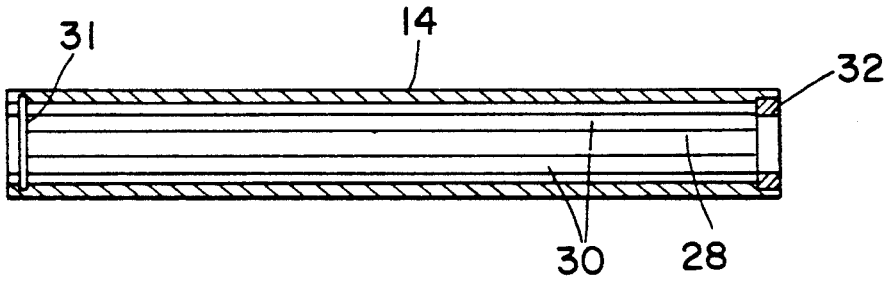
FIG. 7 is a cross-sectional view of the transparent sleeve taken along line 4—4 in FIG. 1 with parts removed.
Figure 7A:
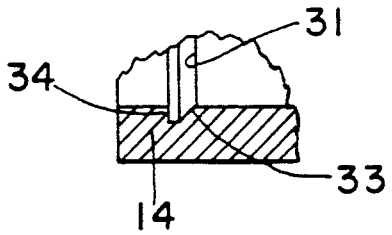
Figure 8:
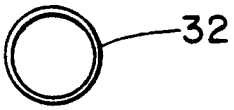
FIG. 8 is a plan view of a protective ring collar that fits into the transparent sleeve of FIG. 7.

As shown in FIG. 7, an end ring collar 32 shown in FIG. 8 is attached inside the end of sleeve 14 corresponding with the socket end of shaft 12 to prevent scratching by a screw received by this end of sleeve 14.

The sleeve 14 is slidable from a fully extended position relative to shaft 12 to a fully retracted position on shaft 12. In this regard, FIG. 1 illustrates sleeve 14 placed in the fully retracted position.

To prevent the sleeve 14 from sliding off shaft 12 toward the drill when sleeve 14 is positioned in the fully retracted position, a circular retaining ring 38, best seen in FIG. 1, is positioned in groove 24 located adjacent the drill end of shaft 12 as shown in FIG. 4. A portion of this ring 38 extends above the groove and the diameter of ring 38 is sized to be larger than the internal diameter of shaft 12. When the drill end of shaft 12 reaches ring 38, further sliding movement of sleeve 14 in the retraction direction is stopped.

Figure 6:
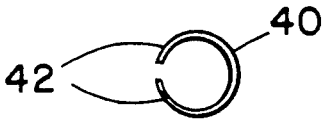
FIG. 6 is a plan view of an oval retaining ring fitted adjacent the socket of the shaft.

To prevent the sleeve 14 from sliding off shaft 12 when sleeve 14 is repositioned to the fully extended position, a split, oval shaped retaining ring 40, as shown in FIG. 6, is positioned in groove 26 located adjacent the socket end of shaft 12. The oval ring 40 has an annular shape so that there are no sharp edges to scratch the transparent sleeve 14. The oval ring 40 has a major and minor axes aligned according to the oval shape. The ends of split ring 40 are provided adjacent the minor axes and the ring is shaped so that the ends of split ring 40 are entirely positioned within groove 26 with no portion of these ends extending above groove 26. The oval ring 40 is constructed of resilient material and sized to have its major axis, in an at-rest position, extend outside the groove, the major axis being sized to be greater than the internal diameter of sleeve 14. The ends of split ring 40 are spaced apart in the at-rest position to allow for compression of the oval ring 40 along its major axis. With this construction oval ring 40 tends to frictionally hold sleeve 14 in any position on shaft 12 between the fully extended and fully retracted positions while the ends of ring 40 are held within groove 26 so as not to scratch sleeve 14.

An internal circumferential groove 31 is provided on sleeve 14 adjacent the drill end of sleeve 14, as best seen in FIG. *7a*. This groove is bound by a bevelled portion 33 bevelling inwardly, with respect to the sleeve 14, toward the other end of sleeve 14 and by a stopwall portion 34 on the other side of groove 31 as shown in FIG. *7a*. The groove 31 is sized to accept oval ring 40 when sleeve 14 is moved to the fully extended position. The stopwall 34 cooperating with ring 40 prevents the sleeve from sliding off the shaft 12 when sleeve 14 is fully extended. The bevelled portion 33 permits ring 40 to slide out of groove 31 when sleeve 14 is retracted from its fully extended position.

In operation, an operator places shank 16 into the chuck of a powered drill, and places a bit 20 into socket 18. When bit 20 is placed on a screw, sleeve 14 can be extended to cover the bit and screw, and can be pushed against the work piece. In this position the screw can be held in a driving position relative to the work piece. As the screw is driven into the work piece, the operator can see the progress of driving the screw through transparent sleeve 14. Smallest radii walls 28 of sleeve 14 slide over the cylindrical surface of shaft 12 and may be scratched in the processes, but walls 30 are held away from shaft 12 where they are not scratched.

As sleeve 14 is rotated or extended, the ends of the oval retaining ring 40 are held in groove 26 and do not scratch the sleeve 14. Only the smooth surface of oval retaining ring 40 adjacent the major axis of the oval ring engage sleeve 14 as the sleeve is moved relative to shaft 12.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. An improved screw holding and driving device for use with a power drill and with conventional socket bits, the device comprising:

a shaft having a socket at one end thereof for receiving the socket bit and a shank at the other end thereof to be received by the power drill;

a transparent sleeve having an internal diameter sized to slidably rotate on the shaft;

the sleeve being adapted to be positioned on the shaft in surrounding relation to the shaft; and the sleeve having a fluted interior surface.

2. A device according to claim 1 wherein the sleeve is movable from a fully extended position to a fully retracted position and further including a first stop means for preventing the sleeve from sliding away from the shaft when the sleeve is moved to the fully extended position.

3. A device according to claim 2 further including a second stop means for preventing the sleeve from sliding off the shaft when the sleeve is moved to the fully retracted position.

4. A device according to claim 3 wherein the first stop means includes:

a stop groove formed on the shaft adjacent the socket;

a compressible split oval retaining ring, positioned in and being held within the stop groove, the oval retaining ring having a major axis and a minor axis;

the oval retaining ring further being sized to have its major axis larger than the internal diameter of the sleeve;

a bevelled groove formed on the sleeve adjacent the end corresponding with the socket end of the shaft for releaseably receiving the oval retaining ring; and the oval retaining ring having the split ends formed adjacent a minor axis and positioned within the stop groove.

5. A device according to claim 4 wherein the bevelled groove is bounded with a stop wall on the side closest the drill end corresponding with the drill end of the shaft; and the bevelled groove is bounded on the other side with an inclined surface inclined inwardly with respect to the sleeve and toward an end of the sleeve corresponding with the socket end of the shaft.

6. A device according to claim 5 wherein the second stop means includes:

a retraction stop groove formed on the shaft adjacent the drill end; and a circular stop ring positioned within the retraction stop groove and sized when positioned in the retraction stop groove to have an outside diameter larger than the internal diameter of the sleeve.

7. A device according to claim 6 further including a ring collar means, attached inside an end of the sleeve corresponding with the socket end of the shaft, for protecting this end of the sleeve from abrasion;

the ring collar is sized to slide over the shaft.

* * * * *